United States Patent [19]

Wajcmann

[11] 4,133,279

[45] Jan. 9, 1979

[54] SEWING APPARATUS

[76] Inventor: Siegfried Wajcmann, c/o 5434 St. Dominique St., Montreal, Quebec, Canada

[21] Appl. No.: 771,764

[22] Filed: Feb. 24, 1977

[30] Foreign Application Priority Data

Mar. 16, 1976 [GB] United Kingdom ..... 10370/76

[51] Int. Cl.[2] ..... D05B 35/10; D05B 27/10; D05B 65/06

[52] U.S. Cl. ..... 112/153; 112/209; 112/214; 112/287

[58] Field of Search ..... 112/153, 152, 203, 121.11, 112/121.12, 121.15, DIG. 2, DIG. 3

[56] References Cited

U.S. PATENT DOCUMENTS

| | | | |
|---|---|---|---|
| 3,204,591 | 9/1965 | Pickett | 112/DIG. 2 |
| 3,252,437 | 5/1966 | Pickett | 112/DIG. 2 |
| 3,631,826 | 1/1972 | Morgan | 112/153 X |
| 3,825,250 | 7/1974 | Miller | 112/DIG. 2 |
| 3,875,881 | 4/1975 | Marjorio | 112/153 |
| 3,905,316 | 9/1975 | Mall | 112/153 |
| 3,913,507 | 10/1975 | Pollmeier | 112/153 |
| 4,013,026 | 3/1977 | Hall | 112/153 |
| 4,019,448 | 4/1977 | Marjorio | 112/153 |

*Primary Examiner*—H. Hampton Hunter

[57] ABSTRACT

There are provided improvements relating to sewing machines for use in the textile field where two or more layers of material are to be sewn together with a conventional sewing head. In the sewing apparatus, there is provided a positioning member for positioning the layers of fabric to be sewn in which one layer passes above and the other below the positioning member; the positioning member includes first means for displacing a pressurized gaseous flow along one major surface of the positioning member to position the first layer of material and a second source of a gaseous flow along the other of the major surfaces of the positioning member to position the other layer of material. There is also provided, in another embodiment, drive means for engaging the surface of one of a pair of layers of material to be advanced to a sewing machine with pneumatic means for reciprocating the drive means into and out of fabric engaging positions with pneumatic means for reciprocating the drive means and a rotatable drive component for the drive means which is flexibly connected to the drive means to be displaceable with the drive means. Still further, there is also provided a detecting means for detecting the movement of fabric in which there is included time delay means associated with a sensing means, thread cutting means being provided for cutting thread from the sewing machine and means for reciprocating the thread cutting means into and out of a thread-cutting position in response to the movement of the fabric in a time delayed relationship.

5 Claims, 13 Drawing Figures

SEWING APPARATUS

The present invention relates to sewing apparatus and more particularly, to improvements in guiding material to be sewn to the sewing apparatus.

The textile field and in particular, the art relating to the manufacture of garments, has generally been a labour intensive one. In this respect, many proposals have been advanced in the art for the automation of various operations required in the manufacture of, for example, garments; however, the use of a skilled operator is still generally required for the actual sewing operation. Thus, though highly automated sewing machines are employed to a great extent in industrial use, such machines still rely on a human operator for guiding the material or fabric to be sewn into a correct operative relationship with the sewing mechanism — i.e. the needle, etc.

It is therefore an object of the present invention to provide an improved means for guiding material or fabric to the sewing machine so as to retain the same in the desired position with respect thereto.

It is a further object of the present invention to provide an automatic edge sewer system which can fit any type of sewing head and is sufficiently versatile to be adaptable to use for many different types of sewing operations — i.e. lock stitch, chain stitch, overlock, safety stitch, etc.

It is a further object of the present invention to provide an automatic edge sewer obviating the requirement of a skilled operator; only material loading while the apparatus is running being required.

It is still a further object of the present invention to provide improvements in a sewing apparatus wherein two or more layers of material to be sewn together are automatically guided to the sewing machine and retained in a desired operative position such that the materials are always maintained in the desired relationship.

More particularly, in accordance with the present invention, there is provided a device which overcomes the problems associated with the prior art devices. In accordance with this invention, in a sewing apparatus including a sewing machine for sewing two or more layers of similar or dissimilar material together, wherein the sewing is carried out by the sewing machine relative to a fixed generally planar surface, there is provided the improvement comprising a material positioning device mounted in co-planar relationship to said fixed surface and in a spaced-apart relationship thereto, said positioning member having a pair of opposed major faces whereby there is formed a passageway between one of said major faces and said fixed surface with a first layer of the material to be sewn being adapted to pass therebetween and a second layer of said material to be sewn being adapted to pass over the other of said major faces of said positioning device, means operatively associated with said positioning member for displacing a pressurized gaseous flow along one of said major surfaces, means operatively associated with said positioning member for dispensing a second pressurized gaseous flow along the other of said major surfaces whereby said gaseous flow along said major surfaces is adapted to position layers of material.

In further embodiments of the present invention, the above positioning device includes guiding means for guiding material to be sewn as it passes through the positioning device and to this end, the guiding means preferably comprises a fixed means defining a portion of a guide path between the fixed surface and the spaced-apart surface and as well, on the other major surface of the positioning device.

Still further, the above positioning device preferably comprises a generally planar member having a pair of opposed major faces; the device preferably includes a like member with a pair of opposed major faces spaced from the first member to define a second passageway between the outer surface of the first member and the inner surface of the second planar member.

The device of the present invention is adapted to be secured to a sewing apparatus or a like component associated with sewing apparatus, such as a work table or the like. As such, such apparatus includes a fixed surface whether it be a portion of the sewing apparatus or an associated work table. Any suitable means for mounting the device to the sewing apparatus or work table may be employed such as clips, screws, etc.

In a particularly preferred embodiment, the means for mounting the material positioning device may also form the guide means for guiding material as it passes through the positioning device. To this end, pins or shafts may be fixedly secured to one or both of the material positioning members and likewise, to the work table or sewing table. In place of pins or the like, a fixed contoured wall may be provided; in either embodiment, the guide means which may also function to mount the positioning device may be made adjustable to compensate for different contours as desired.

As outlined previously, the positioning device is spaced from the work surface to form a passageway between which one layer of material to be sewn travels. The spacing between the work surface and the first member of the positioning device will vary depending on the type of material being sewn, and other operating parameters involved in a sewing operation.

The first and second generally planar members may be formed of any suitable material — for example, metallic material such as aluminum, steel, alloys or even plastic material capable of forming a planar surface. The actual configuration of the planar surface is not critical per se but will depend on various types of materials to be sewn, etc. Preferably, each of these planar members is dimensioned so as to be less than the width of the material being sewn.

The material positioning device includes means associated with it for dispensing a source of pressurized gaseous material; this means preferably includes means for supplying the source of pressurized air or the like, and includes means for splitting this flow of pressurized gaseous material in a desired ratio to form two separate flow streams of pressurized gaseous material, one of the streams being directed from a first face of the member and the second stream being directed through a second face of the member. Generally, the flow streams are directed inwardly with respect to the edge guide means to exert a force on the layers of material or fabric to retain the same in an abutting relationship with the edge guide.

The pressurized gaseous material may be any suitable one and conveniently, air is used for its accessibility. Furthermore, in most industrial sewing operations, a supply of compressed air is commonly used for other operations and a common supply may be employed for the purpose of the present invention.

The edge guide referred to above is spaced inwardly of the sewing machine needle a predetermined distance according to the operation which is desired. Thus, if a hemming operation is performed, the edge guide is spaced inwardly corresponding to the desired hem. In this respect, the edge guide is of an arcuate configuration and is preferably formed by the aforementioned pins. By so doing, materials having a curved configuration may be sewn by using the guiding member outlined above.

In a further aspect of the present invention, there are provided means acting on one of the aforesaid layers of material to regulate the rate at which said one layer is fed to the sewing machine. Conveniently, the apparatus may thus include a presser foot located between the sewing machine and the aforementioned means for guiding the material to be sewn. This presser foot may operate on the lower layer of material to apply a retarding force thereto and thereby adjust the rate at which the same is fed to the sewing machine. Conveniently, the presser foot is adjustable with respect to the retarding force applied and may comprise a retarding member actuated by adjustable pneumatic means.

In a further aspect of the invention, the work table has incorporated therein means for creating a cushion of air directed in a desired direction. By so doing, the material, after undergoing the sewing operation, will be directed in the desired direction by the flowing cushion of air to a stacker or like arrangement. Preferably, the work table includes a plurality of nozzles connected to a pressurized gaseous material such as air and which nozzles are adapted to direct the pressurized air in a direction substantially parallel to the work surface.

Having thus generally described the invention, reference will be made to the accompanying drawings illustrating an embodiment thereof, and in which.

Figure 1:
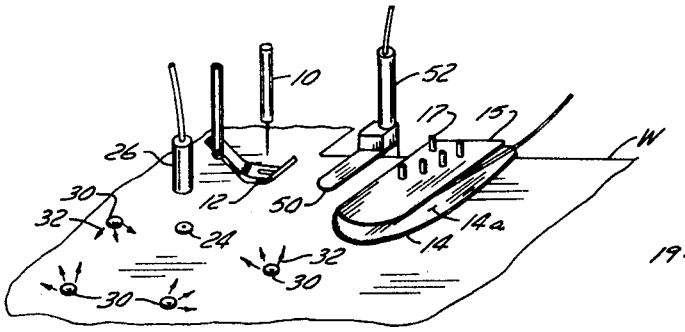
FIG. 1 is a perspective view of a portion of a sewing apparatus according to the present invention.
Figure 2:
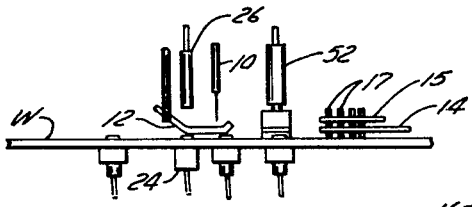
FIG. 2 is a side elevational view of the apparatus of FIG. 1.
Figure 3:
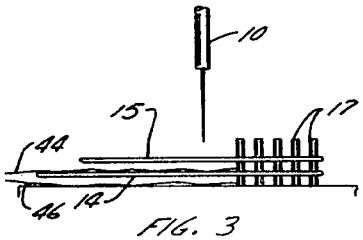
FIG. 3 illustrates the edge guiding means.
Figure 4:
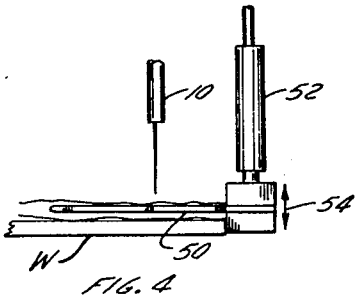
FIG. 4 illustrates the operation of the presser foot of the apparatus of FIG. 1.

Referring to the drawings in greater detail, the sewing apparatus includes a work table generally indicated by reference letter W and which constitutes a fixed surface on which the material to be sewn is passed. The apparatus of this invention is employed in conjunction with a conventional sewing machine (not shown) having a needle 10 and a conventional foot 12.

As illustrated in FIG. 1, the material positioning device of the present invention is indicated generally by reference numeral 14 and comprises a generally planar member having a pair of opposed major faces **14*a* and 14*b*. Each of the faces 14*a* and 14*b* have generally planar surfaces and are in parallel spaced relationship to the work table W. The face 14*a* is the uppermost face while the face 14*b* forms with the surface of the work table a passageway therebetween, between which a layer of material to be processed is passed while a second layer of material to be processed is passed over the face 14*a*** of the positioning device.

The device 14 preferably operates in conjunction with a further planar member indicated generally by reference numeral 15 and which in turn, includes a pair of opposed major surfaces which are preferably parallel with and spaced from the member 14. The inner surface of the member 15 forms with the surface **14*a* a passageway between which the second layer of the material to be processed is adapted to pass — i.e., the passageway between the member 15 and the surface 14*a* is similar to the passageway between the fixed surface of the work table W and the major face 14*b***.

The device of the present invention includes guiding means for guiding the material to be sewn into operative relationship with a sewing machine. As explained previously, these guiding means may assume various configurations but as illustrated, a plurality of guiding pins or studs 17 are provided for this purpose. To mount the pins or studs 17, a plurality of apertures 19 are provided in both of the members 15 and 14, and the apertures 19 are dimensioned so as to receive the pins or studs 17. The studs may be fixedly secured to the plates 14 and 15 as desired, or to the work table W.

Figure 5:
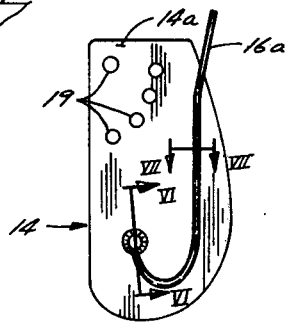
FIG. 5 is a top elevational view of the material positioning member illustrated in FIG. 1.
Figure 6:
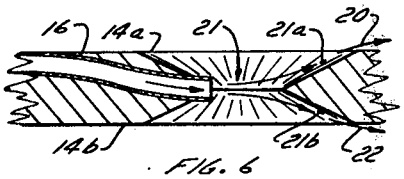
FIG. 6 is a cross-sectional view along the lines 6—6 of FIG. 5.
Figure 7:
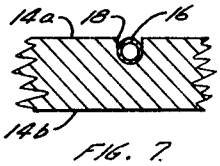
FIG. 7 is a cross-sectional view along the lines 7—7 of FIG. 5.

As will be seen from FIGS. 1 and 5, there is included means associated with the positioning member for dispensing a pressurized gaseous flow. In the preferred form illustrated, this means is integral with the positioning device 14 and to this end, the member 14 includes a conduit 16 mounted in a depression or recess 18 in one of the major faces **14*a* or 14*b*, and which conduit 16 is connected to a source of pressurized gaseous material such as air, through a further conduit 16*a*. The plate 14 includes a conduit or aperture 21 therein which splits into two conduits 21*a* and 21*b* communicating with the respective surfaces and thus essentially forming nozzles to dispense a pair of air streams as indicated by the arrows 20 and 22. These air streams are directed by the nozzles or apertures in the member 14 to opposite faces of the member 14**.

The apparatus illustrated includes a device 24 for receiving a source of pressurized air or the like and dispensing the same to a receiving member 26. These two members constitute a pneumatic sensing device which, in its non-operative state, permits a flow of air to be directed from the nozzle 24 to the receiver 26 and provided the flow of air is not interrupted, the sewing machine will not operate. However, upon advancing a length of material to be sewn together, the fabric being advanced will interrupt the flow of air from the nozzle 24 to the receiver 26 and the interruption will permit operation of a sewing machine to automatically commence.

Figure 8:
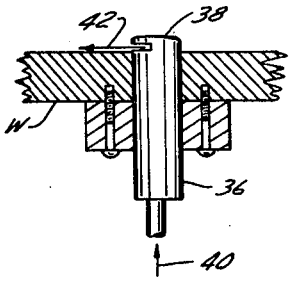
FIG. 8 is a side elevational view of a nozzle arrangement employed in conjunction with the apparatus of FIG. 1.

In a preferred embodiment of the invention, the work table W includes a plurality of air nozzles 30 connected to a source of pressurized air or the like, which are located in the work surface W to direct a flow or air in a direction generally parallel to the work surface as indicated by the arrows 32. As explained previously, these nozzles may provide a cushion of air for facilitating sewing operations. Thus, and by reference to FIG. 8, it will be seen that each nozzle 30 comprises a generally cylindrical conduit 36 to which a pressurized flow of air is fed as indicated by reference numeral 40. The nozzle includes a top portion 38 adjacent one wall of a cylindrical conduit 36 and thus, material fed to a sewing machine will be supported by a thin cushion of pressurized gaseous material. Preferably, the nozzles are all directed in a similar direction such that when the sewing operation is finished, and the material is no longer retained in its operative position, the pressurized gaseous flow emanating from the nozzles will direct the sewn material to a stacker or other suitable arrangement.

In operation, a first layer of material 46 is fed between the lower surface 14*b* of member 14 and the upper surface of table W. A second layer of material 44 enters between the upper surface 14*a* of member 14 and the lower surface of the further member 15. The pressurized gaseous material flow is broken into the two streams 20 and 22 and acts on layers of material 44 and 46 respectively to force the same to abut against guiding studs 17, which, as may be seen from the drawings, form an arcuate outline permitting the sewing of material having curved portions therein.

In the case of feeding certain materials, one of the layers 44, 46 may advance at a faster rate than the other. This has long been a problem associated with sewing two materials together and to overcome the same, the present invention provides an assembly for retarding the rate of feeding of one of the layers. In this respect, as may be seen from the drawings, an assembly 52 including a presser foot 50 is operable such that foot 50 may be moved in the vertical direction as indicated by arrow 54. Assembly 52 is a pneumatic one and the pressure on foot 50 is thus adjustable. Employing the above, foot 50 may apply a desired retarding force on lower layer 46 of the material to be sewn.

As will be seen from the above, except for the motor driving the sewing machine, the apparatus is substantially completely pneumatically operated. Provisions are made for feeding two layers of material to the sewing machine and the modifications disclosed herein may fit any type of sewing head and may be used for many different types of sewing operations.

Figure 9:
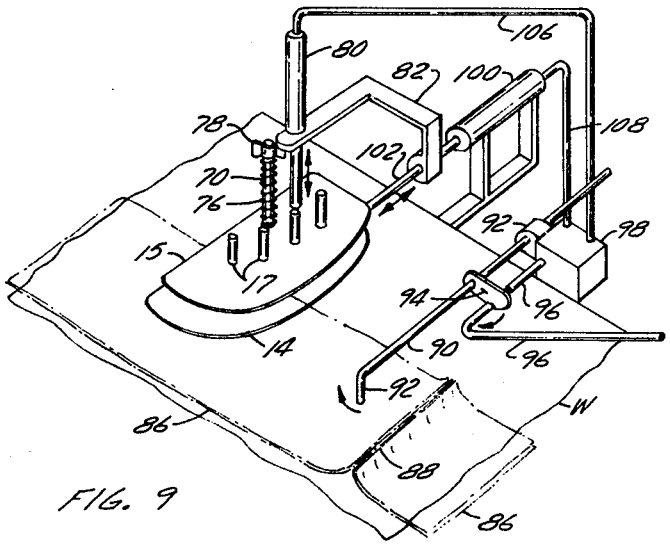
FIG. 9 is a perspective view of a further embodiment of the present invention relating to the movable positioning device.

Referring to FIG. 9, there is illustrated an optional embodiment of the present invention in which the material positioning member may be moved in and out of operative relationship to the work table W. To this end, the system described above with respect to FIG. 1 (with the same reference numerals designating similar components) is utilized but in this case, the upper and lower plates 15 and 14 are fixedly secured to each other by means of a shaft 70, which is threaded at one end and which receives a nut 72. Interposed between the pair of plates 14 and 15 is a somewhat compressible bushing 74 to space the plates apart and a helical spring 76 is mounted on the shaft 70. The spring 76 is urged downwardly against the outer surface of the plate 15 by means of a wing nut 78 or the like. In this manner, both plates are secured together and the shaft 70 acts as a pivot point about which the plates 14 and 15 may pivot, as explained hereinafter in greater detail.

The pneumatic air cylinder 80 is mounted by means of a frame member 82. The frame member 82 may be fixedly secured to a frame component of the apparatus or, as shown, it may be mounted on a piston rod of a further cylinder as described hereinafter. The air cylinder 80 includes the piston rod 84 reciprocal in a vertical direction, and which piston rod 84 is secured at the leading end to the upper plate 15. In this manner, upon reciprocation of the piston rod 84, the plates 14 and 15 may be raised and lowered about the shaft 70 as shown by the dotted lines in FIG. 10.

Figure 10:
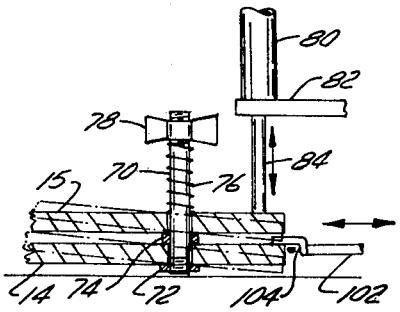
FIG. 10 is a partial vertical section showing the mounting of the members of the positioning device.
Figure 11:
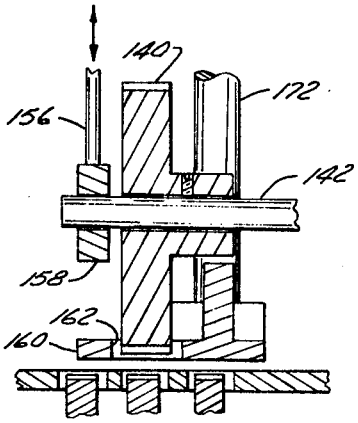
FIG. 11 is a partial vertical section of the device of FIG. 9.

The assembly illustrated in FIGS. 9 to 11 includes means for detecting a joint or bulge in a length of fabric to be sewn. Typically, the fabric as illustrated in dotted lines, and indicated by reference numeral 86, may include a seam line joining two lengths together and which seam line sometimes forms a bulge 88. The detector means for detecting such bulges includes a pivotable arm 90 with a downwardly extending finger 92 normally located in a downwardly extending position or in vertical alignment to the work table W and spaced slightly therefrom. The arm 90 operates in conjunction with a pneumatic cut-off valve 94 fixedly secured thereto whereby rotational movement of the arm 90 will operate the valve. The system includes an air valve 98 operable in conjunction with the arm 90 whereby rotational movement of the arm 90 will actuate the air valve. The cut-off valve 94 likewise operates in conjunction with the air valve 98 through an air conduit 96 supplying air to the air valve 98 and with the cut-off valve being located as shown in FIG. 9. Thus, upon rotation of the arm 90 by virtue of the finger 92 engaging a bulge or the like, the arm 90 is rotated to actuate the unit 98 and at the same time, the arm 90 rotates the cut-off valve 94 as shown in the direction of the arrows in FIG. 9. Upon the bulge passing the finger 92, the arm 90 returns to its original position.

Operating in conjunction with this system is means for rotating the pair of plates 14 and 15 into and out of operative relationship with the work table W. To this end, there is provided a pneumatic air cylinder 100 containing a reciprocating piston rod 102, the leading end of which is connected by means of a bracket 104 to the lower plate 14 as shown in FIG. 10. Thus, upon actuation of the piston assembly 100, the piston rod 102 will reciprocate in the direction of the arrows illustrated in FIG. 9 and thus, cause the plate 14, and optionally the plate 15, to be brought into and out of registry with the fabric 86. The pneumatic cylinders 80 and 100 are connected to a source of pressurized air (not shown) by means of conduits 106 and 108 which in turn, are connected to the air valve 98. Upon actuation of the air valve 98 by means of the arm 96, the piston assemblies 80 and 100 are actuated to function in the above-described manner.

Figure 12:
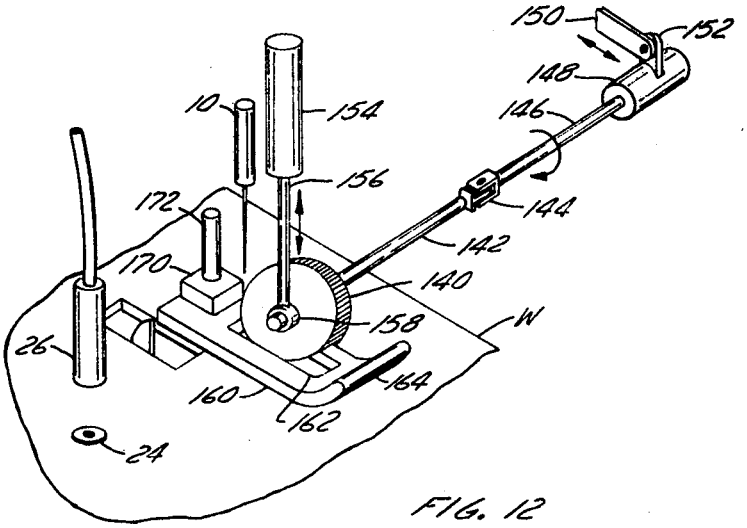
FIG. 12 is a perspective view of a portion of the device of the present invention utilizing the advancing means.

Referring now to FIG. 12, there is illustrated a further optional embodiment of the present invention; in this figure, reference numerals corresponding to those of the previous figures are illustrated for common components. The embodiment of FIG. 12 is adapted to aid in the drive of the fabric being fed and to this end, the drive means includes a rotatable toothed wheel 140 fixedly secured to a drive shaft 142. The drive shaft 142 includes a universal joint 144 which in turn, is connected to a further drive shaft 146 and which at the other end, is connected to a ratchet clutch 148. Drive means (not shown) tied in with the operation of the overall apparatus are employed and which drive means (not shown) is connected to a drive rod 150. The drive rod 150 is connected to a bracket 152 of the clutch 148 whereby reciprocation of the drive rod 150 will rotate shaft 146, and in turn, shaft 142 through the universal joint 144.

The advancing mechanism is adapted to be brought into and out of engagement as required and to this end, a pneumatic cylinder 154 is provided. The cylinder 154 includes a piston rod 156 which journals a bushing 158 mounted on the drive shaft 152. In this manner, upon actuation of the piston, and reciprocation of the same, the piston rod 156 is effective to raise and lower the shaft 142 and thus, the toothed drive roll 140 into and out of engagement.

Mounted in operative relationship to the toothed drive wheel is a guide plate 160 containing an aperture 162 therein sized to receive the drive roller 140. The front portion of the guide means 160 is preferably rounded as illustrated in FIG. 12, and as designated by reference numeral 164. The guide plate 160 may be connected to a suitable frame member by means of a mounting bearing 170 and a frame member 172. A particularly preferred arrangement of the embodiment shown in FIG. 12 includes the operation of the same in conjunction with conventional feed dogs located below the surface of the work platform W and mounted in operative relationship to the drive roller 140. A still further preferred embodiment of the apparatus of FIG. 12 includes the fact that the pneumatic air cylinder 154 is of a type capable of rotating about its shaft 156 whereby upon the raising of the shaft 142 when the piston rod is raised, the piston rod is further effective to permit the drive roller 140 to pivot. To this end, the pneumatic cylinder 154 may be connected to a suitable reciprocating means, such as a further air cylinder, to rotate the complete assembly comprising the air cylinder 154 into and out of alignment with the aperture 162 of the guide means 164. For most embodiments, it is desirable that the amount of pressure exerted by the cylinder 154 and the rod 156 on the driving roller 140 may be varied by providing an appropriate presser control connected to the source of air supply for the cylinder 154 so that varying pressures can be exerted on the fabric as it is being rotated by the wheel 140. In fact, by varying the pressure on the drive roller 140 a differential feed speed for two layers of material can be provided whereby the drive roller 140, advancing the uppermost or top layer of a pair of layers of fabric can "gather" the upper layer to provide a gathering effect of material of the upper layer relative to the lower layer of fabric and thus form sewn layers of fabric having different effects. It will be understood that other modifications can be made to this embodiment.

Figure 13:
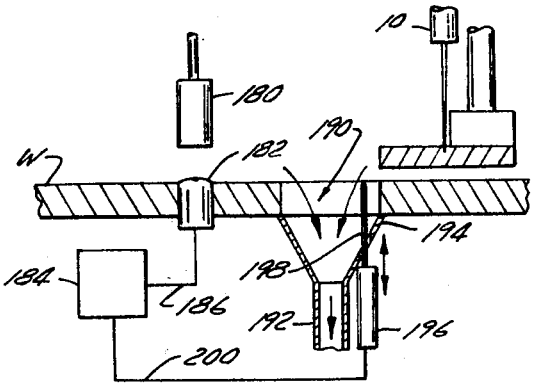
FIG. 13 is a partial vertical section illustrating a further embodiment of the present invention in which there is provided cutting means.

The embodiment of FIG. 13 includes a further optional feature of the present invention wherein there is provided cutting means for the thread operating in conjunction with means for controlling the free ends of thread used in the sewing operation. To this end, the device includes sensing means and which in the embodiment illustrated, includes a pneumatic sensor 180 operating in conjunction with a source of pressurized air dispersed through a nozzle 182. The sensor 180 functions to detect the movement of fabric being sewn by the sewing needle 10 and operates in conjunction with a time delay mechanism indicated by reference numeral 184 and which time delay mechanisms are well known by those skilled in the art. The time delay mechanism is operatively associated with the nozzle 182 by means of connection 186.

In this arrangement, the work surface or table W is provided with an aperture therein indicated by reference numeral 190 and beneath which is a vacuum source (not shown) operatively associated with the aperture 190 by means of a conduit 192 terminating in a funnel-shaped portion 194 surrounding the aperture 190. Operating in conjunction with this assembly is a reciprocating cutting means which in the form illustrated, includes a pneumatic cylinder (not shown) having a piston rod 196 on which there is mounted a cutting blade 198. In this embodiment, the cutting assembly is connected to the time delay means 184 by means of connection 200 to bring the cutting assembly into and out of operative relationship with the surface of the work table W. In operation, upon the detector means 180 and 182 detecting a length of material being sewn, the time delay means 184 is actuated and upon a fixed (but which is variable) time delay, the mechanism 184 is effective to actuate the cutting assembly whereby the cutting blade 198 is brought into cutting position to cut any free thread. In a like manner, the suction means is preferably only operated when required and likewise, may be connected to the time delay mechanism 184 to provide a suction as required during the cutting step.

It will be understood that various modifications can be made to the above-described embodiments without departing from the spirit and scope of the invention as defined herein.

I claim:

1. In a sewing apparatus for sewing two or more layers of similar or dissimilar material together, wherein the sewing is carried out by a sewing machine relative to a fixed generally planar surface, the improvement comprising a generally planar material positioning device mounted in parallel relationship to said fixed surface and in a spaced apart relationship thereto, said positioning device having a pair of opposed major faces whereby there is formed a passageway between one of said major faces and said fixed surface with a first layer of the material to be sewn being adapted to pass therebetween and a second layer of said material to be sewn being adapted to pass between the other of said major faces of said positioning device and a further planar member parallel to said other major face, conduit means associated with said positioning device for delivering a pressurized gaseous flow thereto, said positioning device having a first outlet associated therewith for displacing a pressurized gaseous flow in a generally parallel direction along one of said major surfaces, and a second outlet for dispensing a second pressurized gaseous flow along the other of said major surfaces in a generally parallel direction whereby said gaseous flow along said major surfaces is adapted to position layers of material in an abutting relationship with guiding means, and pneumatically operated means for retarding the rate of feeding of at least one of the layers of material.

2. A device as defined in claim 1, wherein said guiding means comprises means defining a portion of a guide path between said fixed surface and said spaced apart surface, and as well, on the other major surface of said positioning device.

3. A device as defined in claim 2, wherein said means for dispensing a pressurized gaseous flow is integrally mounted in said generally planar first member.

4. A device as defined in claim 1, wherein said apparatus includes means for moving said positioning device into and out of operative relationship to a material engaging position.

5. A device as defined in claim 4, wherein said means for moving said device comprises means for raising or lowering said device and for pivotably reciprocating said device in a planar relationship to said fixed surface.

* * * * *